US008556726B2

(12) United States Patent
Kitakaze et al.

(10) Patent No.: US 8,556,726 B2
(45) Date of Patent: Oct. 15, 2013

(54) GAME SYSTEM AND COMPUTER READABLE INFORMATION STORAGE MEDIUM STORING A COMPUTER PROGRAM THEREFOR

(75) Inventors: Yusuke Kitakaze, Tokyo (JP); Keina Kanisawa, Tokyo (JP); Yasuyuki Nagatomo, Tokyo (JP); Koji Makino, Tokyo (JP); Tadanobu Otaki, Tokyo (JP); Jiro Hotta, Tokyo (JP); Masahiko Kami, Tokyo (JP); Hajime Takahama, Tokyo (JP); Yuuki Harano, Tokyo (JP); Kazutaka Kubota, Tokyo (JP)

(73) Assignee: Konami Digital Entertainment Co., Ltd., Minato-ku, Tokyo (JP)

( * ) Notice: Subject to any disclaimer, the term of this patent is extended or adjusted under 35 U.S.C. 154(b) by 0 days.

(21) Appl. No.: 13/500,425

(22) PCT Filed: Apr. 30, 2010

(86) PCT No.: PCT/JP2010/057720

§ 371 (c)(1),
(2), (4) Date: Apr. 5, 2012

(87) PCT Pub. No.: WO2011/043092

PCT Pub. Date: Apr. 14, 2011

(65) Prior Publication Data

US 2012/0208627 A1 Aug. 16, 2012

(30) Foreign Application Priority Data

Oct. 9, 2009 (JP) ..... 2009-235283

(51) Int. Cl.
*A63F 9/24* (2006.01)

(52) U.S. Cl.
USPC ..... 463/42; 705/35

(58) Field of Classification Search
USPC ..... 463/31–42; 705/35
See application file for complete search history.

(56) References Cited

U.S. PATENT DOCUMENTS

| | | | | |
|---|---|---|---|---|
| 2003/0211889 | A1 * | 11/2003 | Walker et al. | 463/42 |
| 2007/0259710 | A1 * | 11/2007 | Walker et al. | 463/20 |
| 2008/0162316 | A1 * | 7/2008 | Rampell et al. | 705/35 |

FOREIGN PATENT DOCUMENTS

| | | | |
|---|---|---|---|
| JP | 2005-216261 | A | 8/2005 |
| JP | 2008-250946 | A | 10/2008 |
| JP | 2008-257518 | A | 10/2008 |
| KR | 2002042264 | * | 6/2002 |

OTHER PUBLICATIONS

International Search Report mailed Jun. 1, 2010.
Korean Patent Office with English Translation—Issued Jul. 31, 2013.
Japanese Patent Office with English Translation—Issued Jun. 25, 2013.

* cited by examiner

*Primary Examiner* — Masud Ahmed
(74) *Attorney, Agent, or Firm* — Howard & Howard Attorneys PLLC

(57) ABSTRACT

There is provided a game system which is capable of differentiating depending on the payment method of a play fee. The game system where it is possible to pay a game play fee by selecting one payment method from a plurality of payment methods, determines the payment method which the play fee has been paid by (S1), and controls the game in such a way that modification is generated depending on the payment method, on the basis of the determination result (S2-S13).

8 Claims, 5 Drawing Sheets

GAME SYSTEM AND COMPUTER READABLE INFORMATION STORAGE MEDIUM STORING A COMPUTER PROGRAM THEREFOR

CROSS REFERENCE TO RELATED APPLICATION

This application is a national stage application of PCT/JP2010/057720, filed Apr. 30, 2010, which claims priority to Japanese Patent Application No. 2009-235283, filed Oct. 9, 2009, the disclosure of which is hereby incorporated by reference in its entirety.

TECHNICAL FIELD

The present invention relates to a game system where it is allowed to select one payment method from a plurality of payment methods to pay a game play fee.

BACKGROUND ART

In a game system including a commercial game machine which allows a user to play a game in exchange of a payment of a predetermined amount of game play fee, conventionally, it is only allowed that the payment of game play fee is paid by cash (especially, with coins). However, in recent years, proposed is a game system where it is allowed, in addition to the payment of game play fee by cash, to pay the payment of game play fee by methods such as electronic money, a prepaid card and a credit card except cash (for example, see Patent Literature 1), and the practical realization of such game system is ongoing. PTL 1: 2008-257518

SUMMARY OF INVENTION

Problem to be Solved by Invention

However, in the conventional game system, even when a plural of payment methods are allowed, it is only determined whether the game play fee has been paid or not, and it is not discriminated which payment method has been utilized. And, a game control after paying the game play fee is the same regardless of the payment method.

Then, the present invention aims to provide a game system and the like capable of realizing differentiation depending on the payment method of the game play fee.

Solution to Problem

A game system as one aspect of the present invention solves the above problem by being configured as following: the game system which is configured so that one of a plurality of payment methods is selected to pay a game play fee, comprises: a determination device which determines which payment method the game play fee has been paid by; and a game control device which controls a game so that modification is generated depending on the payment method based on a determination result of the determination device.

According to the present invention, it is determined which payment method a game play fee has been paid by. Accordingly, it is possible to generate modification in a game depending on the payment method by reflecting the determination result into the control of the game. Thereby, it is possible to realize a differentiation on the game depending on the payment method. For example, the most felicitous game control is implemented according to the characteristic feature of the payment method; a motivation to use a specific payment method is give to a user.

As one embodiment of the present invention, the game control device may control the game so that, in a case that the game play fee is paid by a specific payment method, a range of game is made available for play, the range being unavailable for play in a case the game play fee is paid by another payment method. Thereby, when the game play fee is not paid by the specific payment method, the unavailable range for play is generated in the game. It is possible to give to the user, a motivation to use the specific payment method. Further, the game control device may make game play possible in the unavailable range for play depending on whether the game play fee has been paid by the specific payment method, by changing a control process for proceeding a predetermined range of game which is provided as a counter value of the payment of the game play fee, from a control process in a case when the game play fee has been paid by the other payment method. Thereby, in the predetermined range of game which is provided as the counter value of the game play fee, in a case that the game play fee has been paid by the specific payment method, it is possible to make a range occur, the range being the unavailable range for play in a case that the other payment method has been selected. Thereby, even if a single game play fee is set regardless of which payment method, it is possible to differentiate the content of game based on whether the game play fee has been paid by the specific payment method, and to give a motivation to select the specific payment method to the user.

As one embodiment of the present invention, the specific payment method may be a payment method of the game play fee by electronic money. Thereby, the control of game is possible a game where the characteristic feature of payment by electronic money, such that it is easy to treat a small amount of payment, is reflected.

For example, as a payment method different from a usual one, in a case that the payment of the game play fee by electronic money is made available, the game control device, when the game play fee has been paid by the specific method, may permit to play continuously an additional range of game as the unavailable range for play n exchange of payment of additional game play fee by the specific payment method after ending a predetermined range of game which is provided as the counter value of payment of the game play fee, and in a case that the game play fee has been paid by the other payment method, the game control device may forbid continuation of the additional range of game after ending the predetermined range of game. Thereby, the payment by electronic money is necessary for user demanding to play the additional range of game. Accordingly, the additional range can be used as motivational means to select the payment method by electronic money.

Moreover, when the predetermined range and the additional range are compared with each other by using time necessary for playing the game as a measure, the additional range may be set so as to be narrower than the predetermined range. The payment by electronic money has a merit that it is not needed to prepare small coins or changes even in a case of a small amount of payment. It is possible to section narrower ranges in a game to be provided, in comparison with a case of the payment by cash which has a limitation because of the units of the papers and the coins. Further, an amount of the additional game play fee may be set so as to be smaller than an amount of the game play fee as the counter charge for playing the predetermined range of game. Thereby, it is possible to control the continuation of game and the additional payment of game play fee in detail.

A computer program of the present invention is configured as following: a computer program for a game system which is configured so that one of a plurality of payment methods is selected to pay a game play fee, makes a computer function as: a determination device which determines which payment method the game play fee has been paid by; and a game control device which controls a game so that modification is generated depending on the payment method based on a determination result of the determination device. It is possible to realize the game system of the present invention by which the computer program of the present invention is executed by a computer of a game system.

Effects of the Invention

As mentioned above, according to the present invention, provided is the determination device which determines which payment method the game play fee has been paid by. Thereby, it is possible to reflect the determination result into the control of the game and generate modification in the game depending on the payment method. Because of this, it is possible to realize a differentiation on the game depending on the payment method.

EMBODIMENT FOR EXECUTING INVENTION

Figure 1:
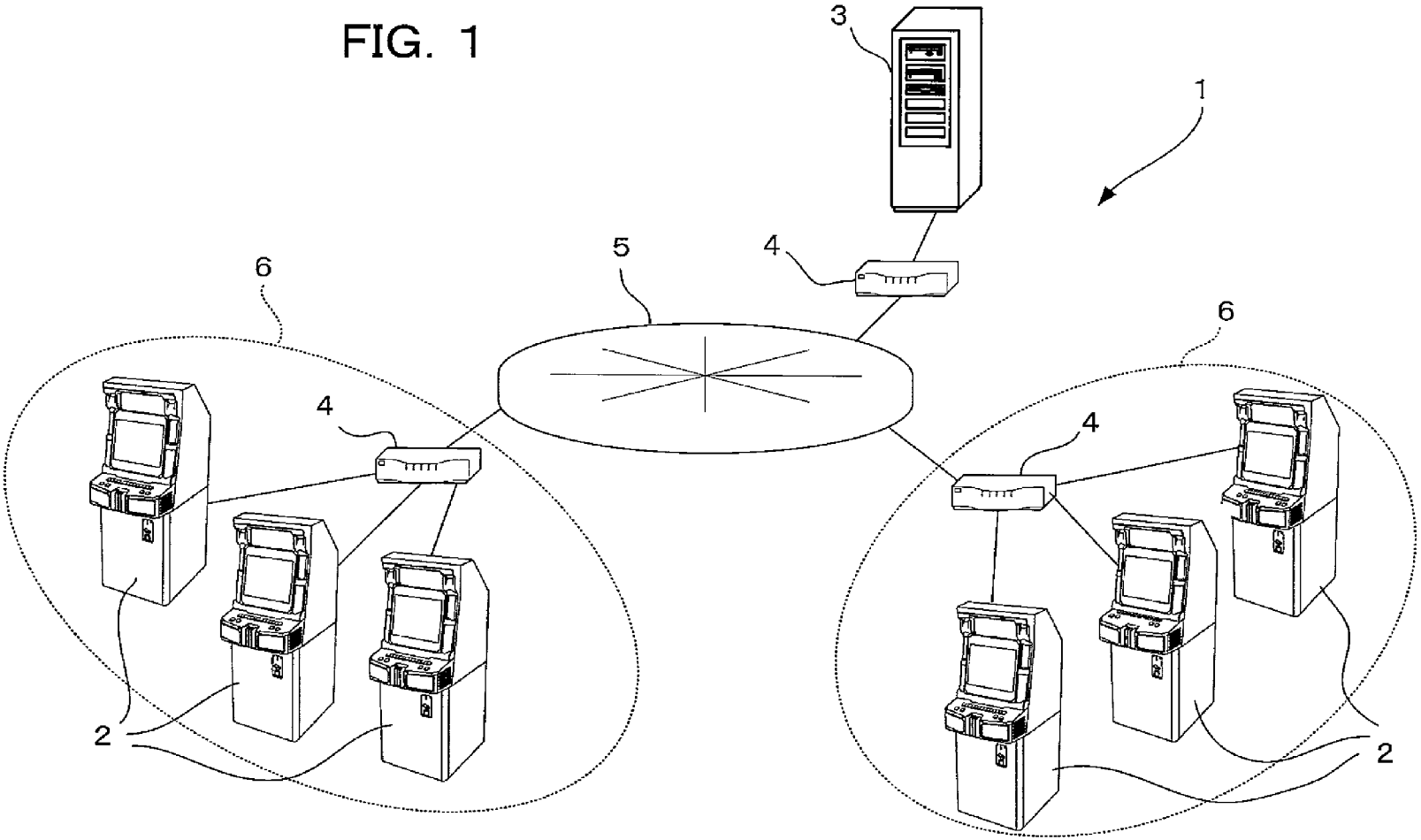
FIG. 1A diagram showing a whole construction of a game system according to one aspect of the present invention.

FIG. 1 shows a game system according to one aspect of the present invention. In the game system 1, a plurality of game machines 2 and a center server 3 are connected to a network 5 via routers 4 respectively. The game machine 2 corresponds to a terminal apparatus of the present invention, and the center server 3 corresponds to a server apparatus. The center server 3 is not only configured as a single physical apparatus, but also may be configured as a logically single apparatus by plural servers as physical apparatuses. Moreover, a single game machine 2 may function also as the center server 3. The network 5 realizes a network communication using the TCP/IP protocol. Typically, the internet is utilized as the network 5. Each of the game machines 2 is configured as a game machine for business use or commercial use where collected is a game play fee as a counter value of a game. The appropriate number of game machines 2 are installed for each facility such as a store 6. Each of the routers 4 is installed in a state of being correlated to any one of the stores or the center server 3. The game machines 2 in the same store are connected to the network 5 via the router 4 which is shared by them. A local server may be installed between the game machine 2 and the router 4 of the store 6, and the game machine 2 may be connected so as to enable a communication to the center server 3 via the local server.

The center server 3 is installed by an operator of the game system 1, and provides various kinds of services via the network 5 to the game machine 2 or a user (a player) of the game machine 2. As an example, the center server 3 provides an update service of game programs or data via the game machine 2, a service of verifying a user of the game machine 2 and storing at the center server play data including a game play history, saved data and the like of the user, a matching service of users for a game where matched users battle, or cooperate, with each other via the network 5, and the like.

To the game machine 2 and the center server 3, given is a unique IP address by which each of the game machine 2 and the center server 3 is identified on the network 5. In the communication between the game machines 3, or between the game machine 2 and the center server 3, a communication partner is specified by using the IP address. In a case that the network 5 is an open network like the internet, a unique fix-address is set to each router 4. To the game machine 2, set as the IP address is a private address for identifying the game machine 2 uniquely on the network 5 by combining with the fix-address. In this case, a virtual private network (VPN) is constructed between the game machine 2 and the server 3, or between the game machines 2, and on the VPN, each game machine 2 is specified uniquely by using the private address.

Figure 2:
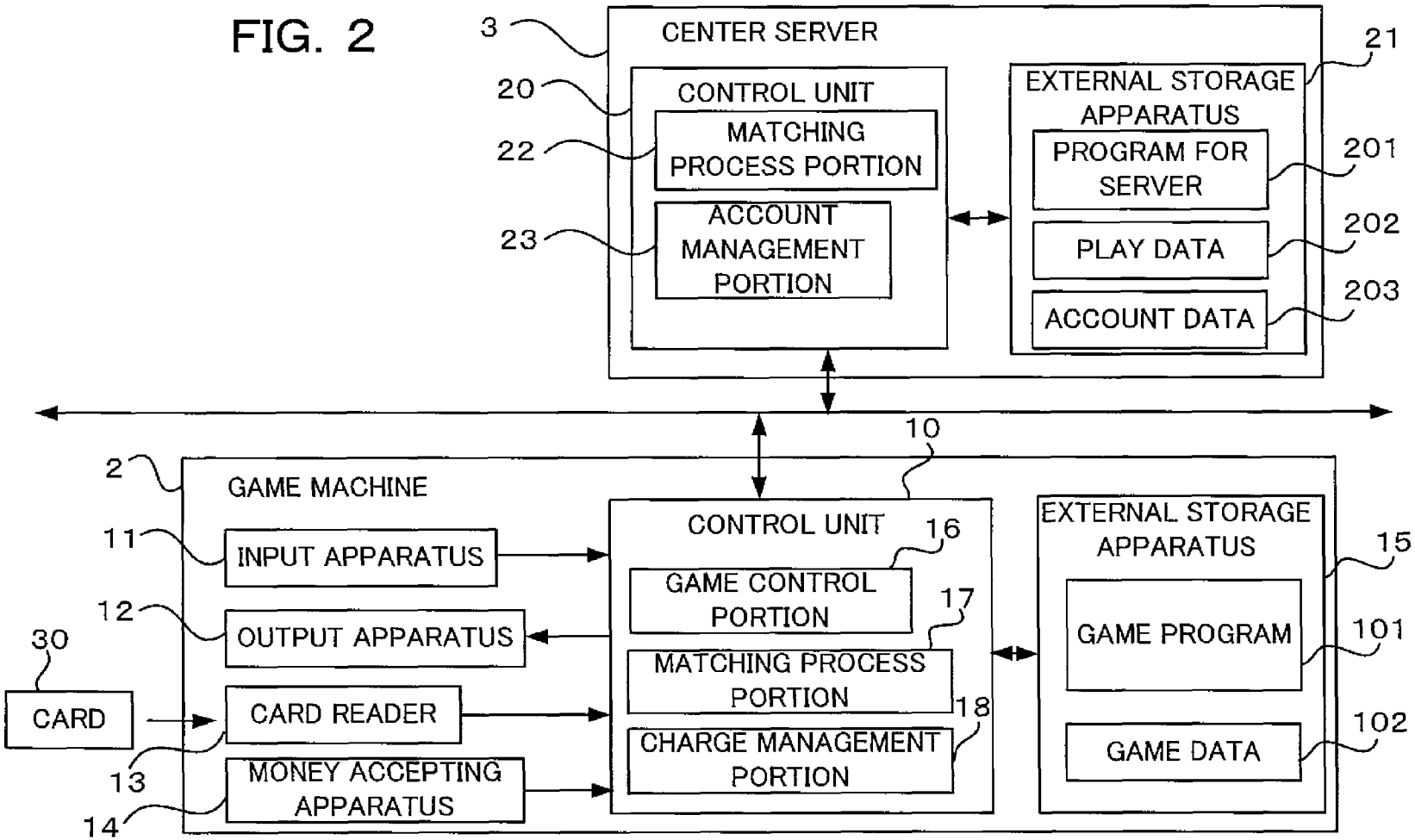
FIG. 2 A functional block diagram of the game system shown in FIG. 1.

In reference to FIG. 2, further described will be the constructions of game machine 2 and the center server 3. The game machine 2 is provide with a control unit 10. The control unit 10 is a computer unit having a microprocessor and internal storage apparatuses (not shown) such as a ROM storing programs to be implemented by the microprocessor such as an operating system, and a RAM providing a work area to the microprocessor. Connected to the control unit 10 is a input apparatus 11, an output apparatus 12, a card reader 13, a money accepting apparatus 14 and an external storage apparatus 15. The input apparatus 11 accepts operations by a user, and outputs signals in accordance with the contents of operations to the control unit 10. The output apparatus 12 includes a monitor which displays a game image and the like, a speaker which outputs a sound and the like. The card reader 13 reads out information from a card 30 held by a user and outputs signals corresponding to the information to the control unit 10. The card 30 is provided with a non-volatile storage medium (not shown) such as an IC chip and magnetic stripes. In the medium, an ID which is unique for each card (hereinafter, sometimes referred to as the card ID) and the like is stored. The card ID may be stored in a state of a bar code or the like. The money accepting apparatus 14 detects the amount of money (coins or notes) inputted by a user, and outputs to the control unit 10 signals in accordance with the amount of input money. The external storage apparatus 15 is a storage apparatus capable of maintaining memories such as a hard disk storage apparatus and the like. The external storage apparatus 15 stores various kinds of data such as a game program 101 to be implemented by the control unit 10 and game data 102 to be referred to by the game program 101.

The control unit 10 reads out and implements the game program 102 stored in the external storage apparatus 15. Thereby, in the control unit 10, a game control portion 16, a matching process portion 17, and a charge management portion are provided as logical apparatuses. The game control portion 16 implements various kinds of processes necessary for playing a game which is provided to a user at the game machine 2, such as management of start, progress and end of a game. The matching process portion 17 implements processes for matching between users in liaison with the center server 3, the processes being necessary for executing a game by using a communication with another game machine 2 in the same store 6 or with the game machine 2 in the other store 6. The charge management portion 18 requires a user to pay the game play fee, and determines whether a required amount of game play fee has been paid or not, that is, implements processes relating to the payment of game play fee. In the present embodiment, as payment means (payment methods) for a game play fee, selectably provided are a payment method by cash utilizing the money accepting apparatus 14, and a payment method by electronic money to be withdrawn from an account being managed by the center server 3. The details of the payment of game play fee will be described later.

The center server 3 is provided with a control unit 20 and an external storage apparatus 21. The control unit 10 is a computer unit having a microprocessor and internal storage apparatuses (not shown) such as a ROM storing programs to be implemented by the microprocessor such as an operating system, and a RAM providing a work area to the microprocessor. Although an input apparatus such as a keyboard and an output apparatus such as a monitor are connected to the control unit 20, the illustrations thereof are omitted. The external storage apparatus 21 stores a program for server 201 to be implemented by the control unit 20 and various kinds of data to be referred to by the program for server 201. In the external storage apparatus 21, as one kind of data which the control unit 20 should refer to, play data 202 and account data 203 are stored.

The play data 202 is an aggregate of records, each record having information relating to game play contents of a user, such as a play history and results, in association with the card ID of the card 30 held by the user. The account data 203 is an aggregate of records, each record having the amount of electronic money held by the user in association with an ID which is given uniquely to the user (hereinafter, referred to as the user ID.) The card ID and the user ID are correlated to each other in a stated of one-to-one or many-to-one. In the external storage apparatus 21 of the center server 3, also stored is data for discriminating the correlation between the IDs. A user can increase the amount of electronic money (a deposit) held in the account data 203 via an website and the like managed by the system manager and the like. The charge to the user corresponding to the deposit of electronic money is executed separately by settlement means, for example, a credit card and the like. Alternatively, the electronic money may be deposited in exchange of cash by using a terminal dedicated to electronic money deposit. The deposit of electronic money to the account data 203 and the settlement thereof can be the same as them of a system for prepaid-type electronic money. Accordingly, the detail explanation of them is omitted.

The control unit 20 reads and implements the program for server 201 stored in the external storage apparatus 21. Thereby, in the control unit 20, a matching process portion 22 and an account management portion 23 are generated as logical apparatuses. The matching process portion 22 implements processes for matching between users of plural game machines 2 in response to matching requirements from the game machines 2. The account management portion 23 implements, in response to a withdrawal requirement for a game play fee from the game machine 2, processes relating to the management of electronic money, for example, withdraws an indicated amount of electronic money from the record corresponding to the account data 203. In addition to the logical apparatuses shown in the figures, various kinds of logical apparatuses may be generated as necessary in each of the control unit 10 of the game machine 2 and the control unit 20 of the center server 3.

Figure 3:
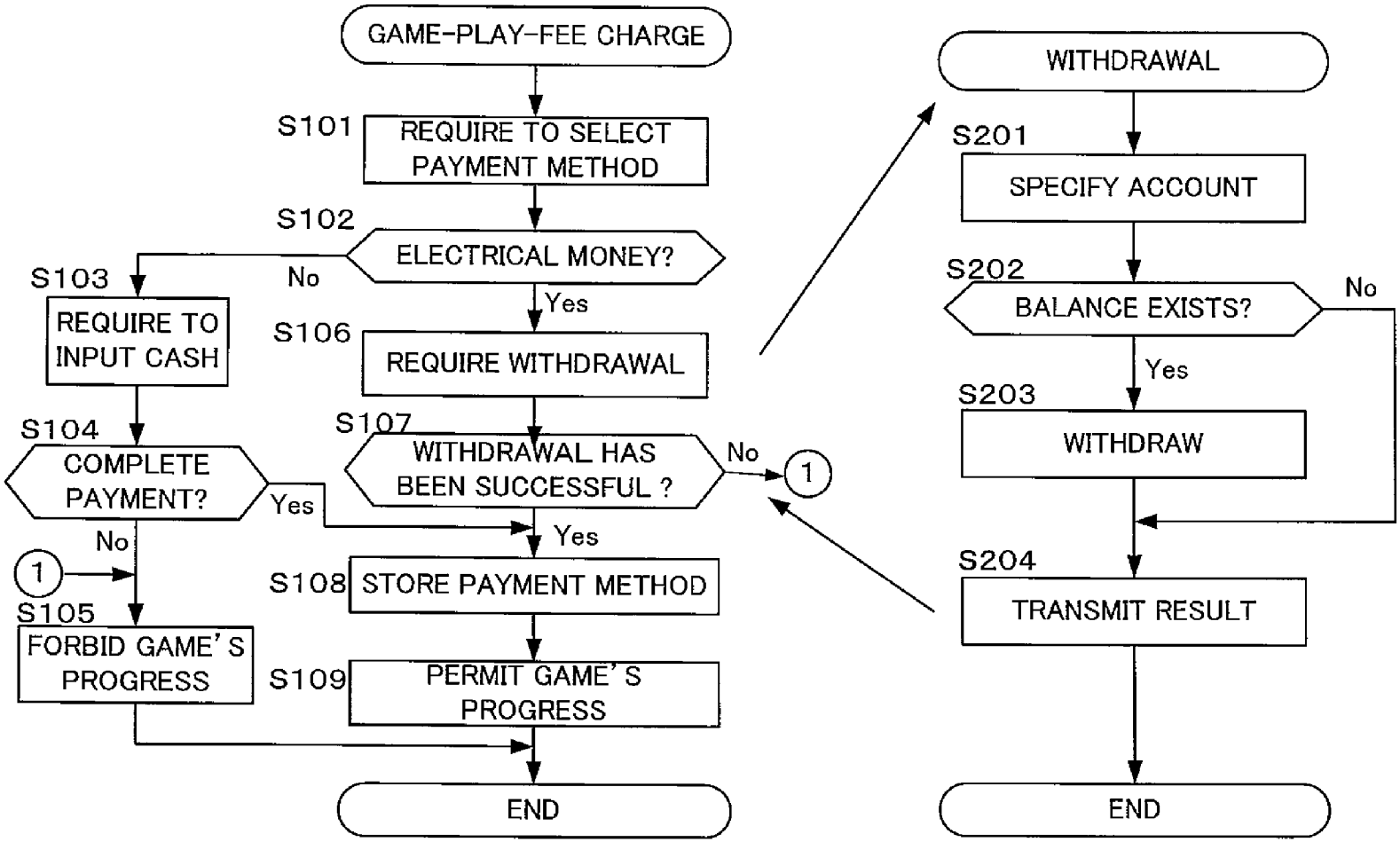
FIG. 3 A flowchart showing processing to be implemented at the moment of collecting the game play fee.

Next, in a case that a user plays a game at the game machine 2, explained will be the processes implemented by the control unit 2 and the like of the game machine 2. FIG. 3 shows the processes in each of the game machine 2 and the center sever 3, the processes being implemented at the moment when the game play fee is collected from a user. Note that the processes in FIG. 3 are implemented before a game starts and after the user makes the card reader 13 of the game machine 2 read the card 30 and the control unit 10 identifies the card ID of the card 30. When collecting the game play fee, the control unit 10 of the game machine 2 implements a game-play-fee charging routine shown in FIG. 3 by using the charge management portion 18. At the first step S101 of the game-play-fee charging routine, the control unit 10 requires the user to select the payment method (the payment means) for the game play fee. In this case, the user can select either the method of paying the game play fee by cash via the money accepting apparatus 14 (hereinafter, referred to as the cash payment), or the method of paying the game play fee by electronic money storing in his/her own account (hereinafter, referred to as the electronic money payment).

Subsequently, at step S102, the control unit 10 determines whether the user has selected the electronic money payment or not. In a case that the electronic money has not been selected, that is, the cash payment has, the control unit 10 proceeds to step S103 to require to input a predetermined game play fee into the money accepting apparatus 14. Subsequently, at step S104, the control unit 10 determines whether the payment of the game play fee has been completed in a predetermined period or not, by referring to the output from the money accepting apparatus 14.

In a case that the payment has been completed, the control unit 10 proceeds to step S108 to stores that the game play fee has been paid by cash as the result of payment. Subsequently, at step S109, the control unit 10 allows the game's progress and terminates the game-play-fee charging routine of this time. On the other hand, in a case that the payment has not been completed, the control unit 10 proceeds to step S15 to forbid the game's progress and terminate the game-play-fee charging routine of this time.

At step S102, in a case that the electronic money payment has been selected, the control unit 10 proceeds to step 106 to require the center server 3 to withdraw the game play fee from the account. In this case, in order to make the center server 3 specify the account of the user and withdraw a correct amount of game play fee, included in the requirement generated at step S106 are the amount of game play fee which should be withdrawn and the card ID for specifying the account. After that, the control unit 10 proceeds to step S107 to wait for the result of the withdrawal from the center server 3 and determine whether the withdrawal is successful or not.

On the other hand, when receiving the withdrawal requirement from the game machine 2, the control unit 20 of the center server 3 starts a withdrawal routine shown in FIG. 3 by using the account management portion 23. In the withdrawal routine, the control unit 20 specifies the record of the user's account out of the account data 203 at step S201, by using the card ID sent from the game machine 2. Subsequently, at step S202, the control unit 20 determines whether a balance (the amount of electronic money deposited) is not less than the amount of game play fee exists in the user's account. In a case that the balance exists, the control unit 20 proceeds to step S203 to withdraw the game play fee from the user's account, that is, update the account data 203 in such a way that the amount of electronic money corresponding to the game play fee is reduced from the user's account. On the other hand, at step S202, in a case that the balance is deficient, the control unit 20 skips step S203. Subsequently, at step S204, the control unit 20 transmits to the game machine 2 the result of the withdrawal, that is, information for determining whether the withdrawal is successful or not, and thereby, terminates the withdrawal routine.

The control unit 10 of the game machine 2 which receives the result of withdrawal, determines whether the withdrawal is successful, the control unit 10 proceeds to step S108 to stores that the game play fee has been paid by electronic money as the result of payment. Subsequently, at step S109, the control unit 10 permits the game's progress. On the other hand, in a case that the withdrawal is failed, that is, the game play fee can not be withdrawn because of insufficient funds, the control unit 10 proceeds to step S105 to forbid the game's progress. After implementing step S105 or step S109, the control unit 10 terminates the game-play-fee charging routine of this time as mentioned above. In addition, in a case that the game's progress is forbidden at step S105, the user cannot start the game. On the other hand, in a case that the game's progress is permitted at step S109, the user is allowed to play the game provided by the game machine 2.

Figure 4:
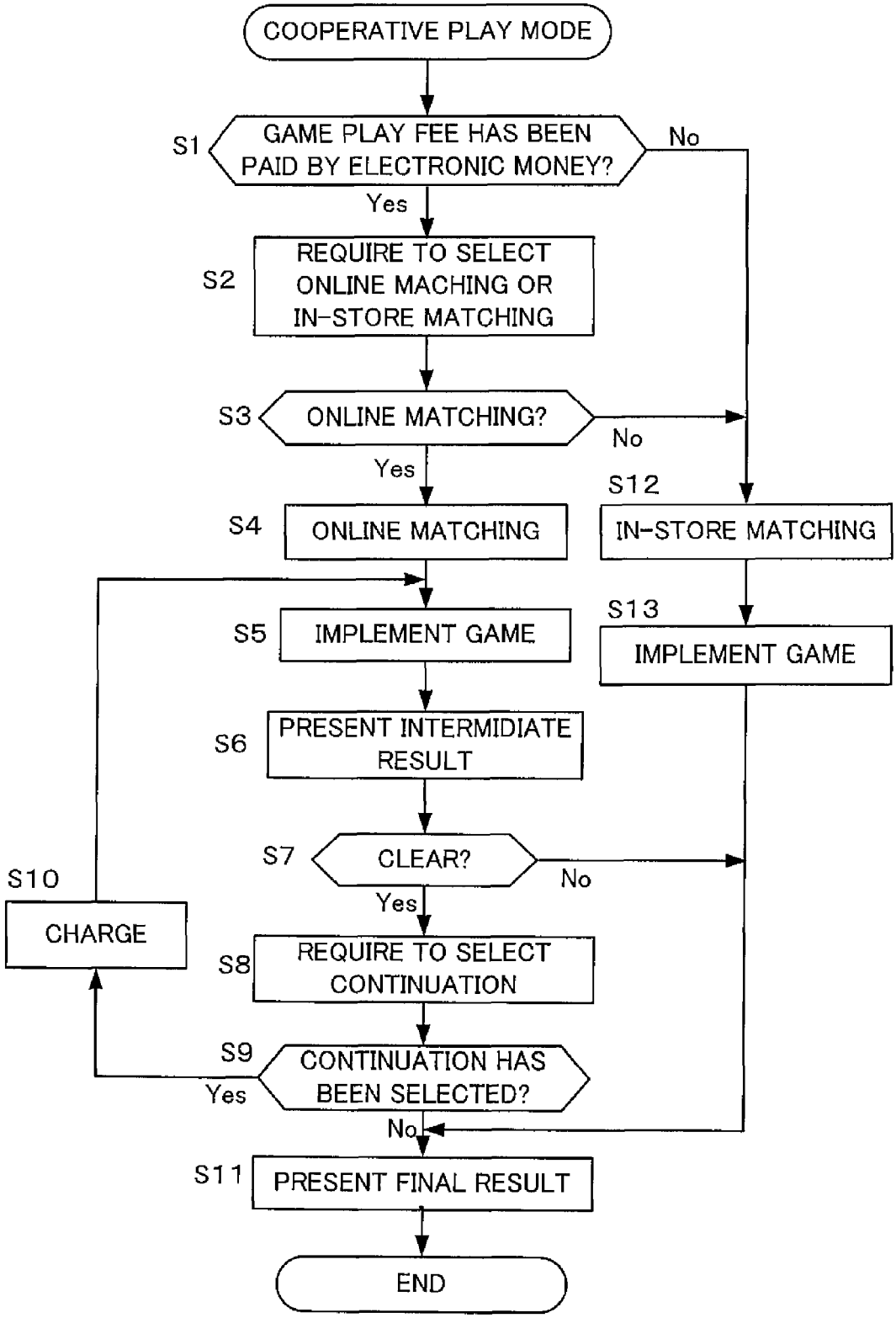
FIG. 4 A flowchart showing an example that control of game is changed depending on the payment method.

FIG. 4 shows a cooperation play mode routine. The cooperative play mode routine is implemented by the control unit 10 of the game machine 2 when the user selects a cooperative play mode. The cooperative play is a play mode where an cooperation of users, such that plural users answer the same quiz cooperatively with each other, is included in elements for progressing a game. When the cooperative play being selected, the control unit 10 first determines whether the game play fee has been paid by electronic money or not at step 1. This determination is implemented based on the stored contents of step S108 shown in FIG. 3. In a case that the game play fee has been paid by electronic money, the control unit 10 proceeds to step S2 to require the user to select either an online matching or an in-store matching. The online matching is matching the user and the other user of the game machine 2 installed in the other store 6. On the other hand, the in-store matching is matching the user and the other user of the other game machine 2 in the same store 6.

Subsequently, at step S3, the control unit 10 determines whether the user has selected the online matching. In a case that the online matching has been selected, the control unit 10 proceeds to step S4 to require the center server 3 the matching, and following the result of matching, prepare an environment for data communication with the game machine 2 of the other store 6. To implement the processes for this, the matching process portion 17 of the control unit 10 and the matching process portion 22 of the center server liaise with each other. The process for the matching requirement to the center server 3 and the process for the matching at the center server 3 are similar to the processes in an already-known game system where a battle or the cooperative play via a network is realized. Accordingly, the details of the processes are omitted.

When the online matching is completed, the control unit 10 proceeds to step S5 to implement a predetermined play range of the game while exchanging data with the game machine 2 matched. The play range of the game in this case is set to a range of time length according to the game play fee paid. At step S5, when the predetermined range of the game ends, the control unit 10 proceeds to step S6 to present the user the result of the game till the range as an intermediate result. Subsequently, at step S7, the control unit 10 determines whether user's play performance satisfies a predetermined clear condition. In a case that the clear condition is satisfied, the control unit 10 proceeds to step S8 to require the user to select whether he/she continues the game or not (selects continuation of the game or not).

Subsequently, at step S9, the control unit 10 determines whether the user has selected the continuation. In a case that the continuation has been selected, the control unit 10 proceeds to step S10 to charge the user for the game play fee necessary for the continuation. After that, the control unit 10 returns to step S5 to resume the subsequent game. The charge at step S10 is a process that the game play fee necessary for continuation of the game is withdrawn from the account data 203. The play range of game executed at step S5 after the charge of step S10, sets smaller than the play range of game executed in a case when the process proceeds to step S5 from step S4 (sometimes, referred to as the first time game). In this case, the sizes of ranges are compared to each other using play time necessary for playing each range as a measure. That is, in a case that the play time of the game after the continuation is selected is shorter than the play time of the first time game, this means that the play range after the continuation is smaller than the play range of the first time game. In a case that there exists variability of the play time depending on play contents of the game, the size of play range may be evaluated by using the length of average play time.

Then, the amount of game play fee required at step S10 is set to smaller than the amount of game play fee required in order to play the first time game. The charge management portion 18 of the control unit 10 and the account control unit 23 of the control unit 20 in the center server 3 liaise with each other to process the charge of step S10 in a similar way to a case of FIG. 3. However, at step S10, except the electronic money the payment of the game play fee (the continuation fee, in this case) is impossible. In a case that the amount of balance equal to the continuation fee does not remain, the charge is impossible. Therefore, the process is implemented in a similar way to a case that it is determined that the clear condition is not satisfied at step S7. In a case that it is determined that the clear condition is not satisfied at step S9, or it is determined that the continuation has not been selected at step S9, the control unit 10 proceeds to step S11 to present the user the result of the game at the moment as a final result, and after that, terminates the routine of this time.

In a case that, it is determined that the game play fee has not been paid by electronic money at step S1, or in a case that the user has selected the in-store matching at step S3, the control unit 10 proceeds to step S12 to match the users of the game machines to each other in the same store 6 by using the matching process portion 17. Subsequently, at step S13, the control unit 10 implements a predetermined range of the game while exchanging data with the other game machine matched. In this case, the play range of game is the same as a play range of game at the moment when the process proceeds to step S5 from step S4. Namely, the play range is similar to a range of the game at the moment when no continuation has been selected after the game starts (this is sometimes referred to as the first time game.) This is because the amount of game play fee charged for the first time game in a case of cash payment is equal to the amount of electronic money which is required in a case of playing the first time game by electronic money payment.

The predetermined range of game is implemented at step S13, the control unit 10 proceeds to step S11 to present the user the result of the game at the moment as the final result. After that, the control unit 10 terminates the routine of this time. That is, in a case that the game play fee has been paid by cash, or in a case that the user selects the in-store matching though the game play fee has been paid by electronic money, only the first time game is possible and the continuation is impossible.

Figure 5:
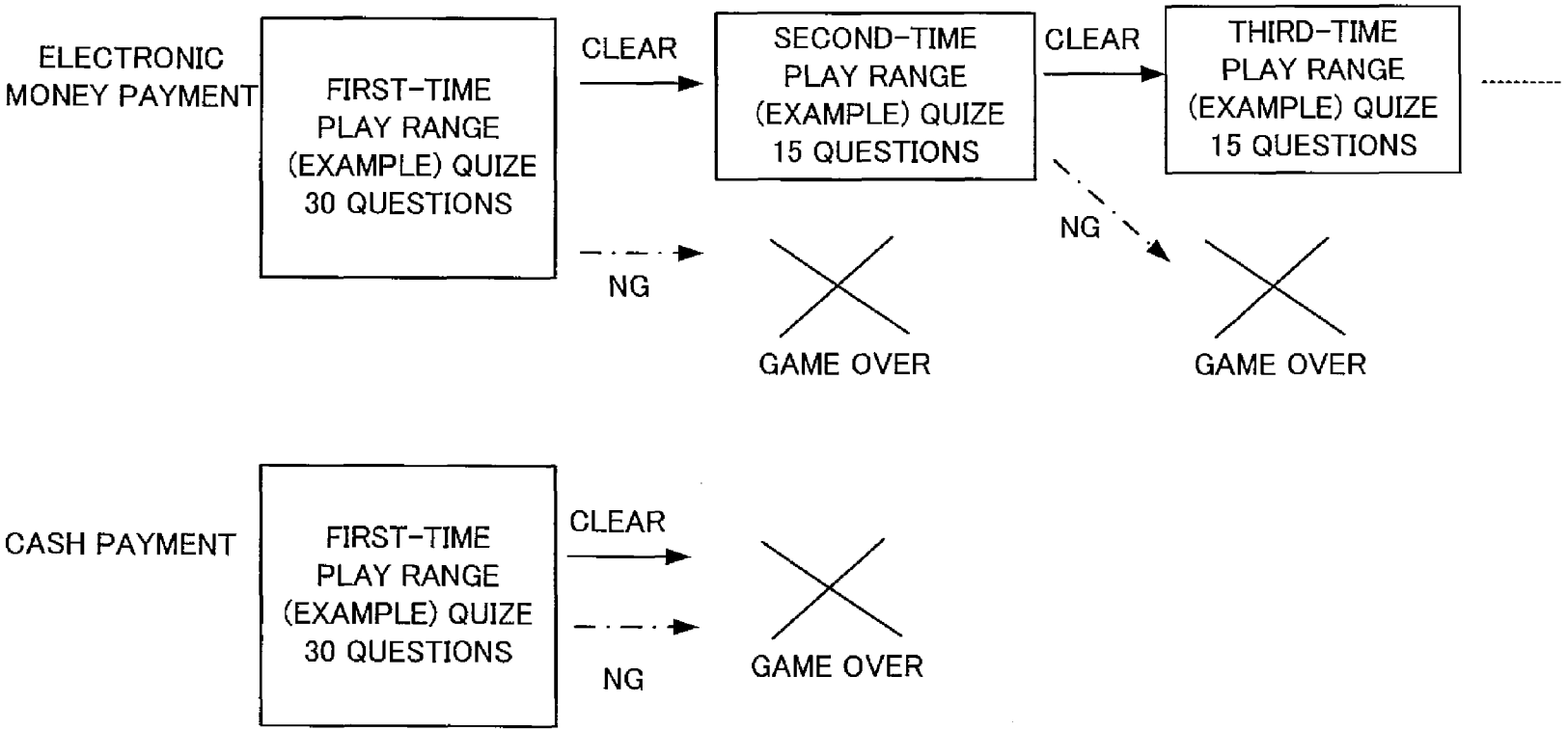
FIG. 5 A diagram showing an example that it is differentiated depending on the payment method whether continuation of game should be permitted.

FIG. 5 shows an example of a relation between the first time game in the game machine 2 and the game to be provided in a case that the continuation has been selected. As shown in FIG. 5, with respect to the play range of the first time game (the first-time play range), the case of electronic money payment and the case of the cash payment are equal to each other. For example, in a case that the game provided at the game machine 2 is designed as a quiz game where a question is issued and the user answers the question, a predetermined number of questions (30 questions, as one example) are issued in the first time game regardless of the payment method. Then, if the result of the quiz is not less than a predetermined level, the first time game is cleared. In a case of electronic money payment, when the first time game is cleared, on condition of payment of continuation fee by electronic money, it is permitted to proceed to a second time game. Then, the play range of the second time game is narrower than the play range of the first time game. For example, the number of questions is reduced to 15. In accordance with this, the game play fee necessary for playing the second time game (the continuation fee) is set to the amount smaller (for example, a half of) than the game play fee for the first time game. After this, in the similar way, the charge of game play fee and the implement of the game are repeated for a range narrower than the play range of the first time game. On the other hand, in a case that the game play fee for the first time game has been paid by cash, regardless of whether the first time game has been cleared, the user can not proceed to the second time game.

As mentioned above, in the game system 1 of the present invention, as long as the game play fee is not paid by electronic money, the user can not play the second time and subsequent games continuously. Thereby, it is possible to give the user a motivation to select a payment method by electronic money. The range of each of the second time and subsequent games (that is, games after the continuation) is narrower than the range of the first time game, and the game play fee for each of the second time and subsequent games is set to smaller amount than the game play fee for the first time game. Accordingly, when the game play fee for the first time game is set to, for example, the amount corresponding to one or a few coin(s) and the game play fee of each of the second time and subsequent games is set to the amount smaller than the amount of one coin, without increasing the kinds of coins acceptable to the money accepting apparatus 14, it is possible to set to a small amount the game play fee necessary for the continuation of each of the second time and subsequent games. Thereby, in addition to reducing the onus of facility investment for the game machine 2, it is possible to treat the range of game to be continued flexibly to user's demand by setting the sections between the continuations in the game and a unit of the game play fee are set minutely.

In the above embodiment, the control unit 10 of the game machine 2 functions as the determination device by implementing step S108 in FIG. 3 and step S1 in FIG. 4, and functions as the game control device by implementing step S2 and subsequent steps in FIG. 4. Also, the first time game corresponds to the predetermined range of game. The game which is implemented at the moment when the control unit 10 returns to step S5 after implementing from step S7 to step S10 in sequence, corresponds to the additional range of game.

The present invention is not limited to the above mentioned embodiment, and is possible to be appropriately modified. For example, in the above embodiment, the control of game is differentiated depending on the payment method in such a way that the online matching and the continuation of game are permitted only when the game play fee has been paid by electronic money, and both of them are unavailable when the game play fee has been paid by cash. However, the contents to be differentiated are variable appropriately. Even in a case that the game play fee has been paid by cash, the online matching may be permitted. And, even in a case that the game play fee has been paid by cash, while permitting the continuation of game, the range continued may be differentiated between a case of cash payment and a case of electronic money payment, and the game play fee necessary for one time continuation may be differentiated according to the range continued.

The differentiation is not limited to an example of differentiation with respect to the continuation of game. For example, the differentiation may be generated as following: in a case of electronic money payment, a special stage makes available to play, and in a case of cash payment or the other payment method, the special stage makes unavailable for play. Alternatively, in a case of electronic money payment, the user can make a character or the like appear in a game to play the game, the character or the like not appearing in the game in a case of the other payment method. The embodiment with respect to the payment method is also not limited to the embodiment that the user can select between the electronic money payment and the cash payment, and also may be employed to the embodiment that the user can select between the cash payment and the payment by a credit card or a prepaid card. Moreover, various kinds of payment methods may be selectable, and modifications depending on the payment method selected may be generated in the control of game.

In the above embodiment, the account of electronic money is configured on the center server so that the game play fee is paid by withdrawing via the network the electronic money equal to the amount of game play fee. Also, for example, the game play fee may be paid by an electronic money system of so-called prepaid type, in which electronic money is charged in a storage medium, such as the card 30 or an IC chip mounted in a portable phone and the like, and the balance of electronic money on the card 30 is reduced in response to payment of the game play fee. In such case, the withdraw of game play fee by electronic money is completed between the game machine 2 and the card 30. Therefore, the game system of the present invention is not limited to an example of a network game system where a game machine and a center server are connected via a network, and the game system may be configured as a game system where no game machine is not connected to a network, that is, a game system which is constituted only by so-called stand-alone type game machines. A game machine is not limited to a game machine which is installed in a store. For example, even if a game system includes a game machine for home use, in a case that a user is charged to play a game via a network, the game system can employed to a game system of the preset invention.

The account of electronic money may be managed on a server different from the center server for realizing a game, and the game play fee may be paid by using a settlement system of electronic money which is provided by an external contractor. Moreover, the payment methods for game play fee are not limited to the cash payment and the electronic money payment, and various kinds of payment methods such as a credit card, a merchandise coupon may be available in a selective state.

REFERENCE SIGNS LIST

1 Game system
2 Game machine
3 Center server
5 Network

6 Store

10 Control unit (determination device, game control device)

The invention claimed is:

1. A game system which is configured so that one of a plurality of payment methods is selected to pay a game play fee, comprising:

a determination device which determines which payment method the game play fee has been paid by; and a game control device which controls a game so that modification is generated depending on the payment method based on a determination result of the determination device, wherein the game control device controls the game so that the modification is generated depending on the payment method in such a way that, in a case that the game play fee is paid by a specific payment method, a range of game is made available for play, the range being unavailable for play in a case the game play fee is paid by another payment method.

2. The game system according to claim 1, wherein the game control device makes game play possible in the unavailable range for play depending on whether the game play fee has been paid by the specific payment method, by changing a control process for proceeding a predetermined range of game which is provided as a counter value of payment of the game play fee, from a control process in a case when the game play fee has been paid by the other payment method.

3. The game system according to claim 2, wherein the specific payment method is a payment method of the game play fee by electronic money.

4. The game system according to claim 1, wherein the specific payment method is a payment method of the game play fee by electronic money.

5. The game system according to claim 4, wherein the game control device permits to play continuously an additional range of game as the unavailable range for play n exchange of payment of additional game play fee by the specific payment method after ending a predetermined range of game which is provided as the counter value of payment of the game play fee, and in a case that the game play fee has been paid by the other payment method, the game control device forbids continuation of the additional range of game after ending the predetermined range of game.

6. The game system according to claim 5, wherein when the predetermined range and the additional range are compared with each other by using time necessary for playing the game as a measure, the additional range is set so as to be narrower than the predetermined range.

7. The game system according to claim 6, wherein an amount of the additional game play fee is set so as to be smaller than an amount of the game play fee as the counter charge for playing the predetermined range of game.

8. A non-transitory computer readable information storage medium storing a computer program for a game system which is configured so that one of a plurality of payment methods is selected to pay a game play fee, the computer program making a computer function as:

a determination device which determines which payment method the game play fee has been paid by; and a game control device which controls a game so that modification is generated depending on the payment method based on a determination result of the determination device, wherein the game control device controls the game so that the modification is generated depending on the payment method in such a way that, in a case that the game play fee is paid by a specific payment method, a range of game is made available for play, the range being unavailable for play in a case the game play fee is paid by another payment method.

* * * * *